US011549223B2

(12) United States Patent
Heusinger et al.

(10) Patent No.: US 11,549,223 B2
(45) Date of Patent: Jan. 10, 2023

(54) SPRAYING DEVICE FOR A CONSTRUCTION MACHINE FOR PROCESSING THE GROUND, A CONSTRUCTION MACHINE WITH A SPRAYING DEVICE AND A METHOD FOR OPERATING A SPRAYING DEVICE

(71) Applicant: BOMAG GmbH, Boppard (DE)

(72) Inventors: Juergen Heusinger, Koblenz (DE); Johannes Forster, Sabershausen (DE); Andreas Nacke, Dessighofen (DE)

(73) Assignee: BOMAG GmbH, Boppard (DE)

( * ) Notice: Subject to any disclaimer, the term of this patent is extended or adjusted under 35 U.S.C. 154(b) by 0 days.

(21) Appl. No.: 16/669,967

(22) Filed: Oct. 31, 2019

(65) Prior Publication Data

US 2020/0063382 A1 Feb. 27, 2020

Related U.S. Application Data

(63) Continuation of application No. 13/209,532, filed on Aug. 15, 2011, now abandoned.

(30) Foreign Application Priority Data

Aug. 23, 2010 (DE) ..... 10 2010 035 129.6

(51) Int. Cl.
*B05B 13/00* (2006.01)
*E01C 19/17* (2006.01)
*E01C 23/088* (2006.01)

(52) U.S. Cl.
CPC ..... *E01C 19/178* (2013.01); *B05B 13/005* (2013.01); *E01C 19/17* (2013.01); *E01C 23/088* (2013.01)

(58) Field of Classification Search
CPC ..... B05B 3/00; E01C 19/178; E01C 23/088
(Continued)

(56) References Cited

U.S. PATENT DOCUMENTS 1,865,109 A * 6/1932 Johnson ..... E01C 23/03 404/111
3,782,634 A * 1/1974 Herman ..... E01H 3/02 239/156

(Continued)

FOREIGN PATENT DOCUMENTS

CN 201082956 Y 7/2008
DE 2161705 A1 8/1972

(Continued)

OTHER PUBLICATIONS

Espacenet, English Machine Translation of German Application No. DE2161705A1, published Aug. 10, 1972, retrieved from http://worldwide.espacenet.com on Mar. 28, 2014 (6 Pages).

(Continued)

*Primary Examiner* — Chee-Chong Lee
(74) *Attorney, Agent, or Firm* — Wood Herron & Evans LLP

(57) ABSTRACT

A spraying device for introducing a fluid into the working chamber of a construction machine for processing the ground or road surfaces, comprises two fluid delivery apparatuses, a line system and a control unit. The present invention further relates to a construction machine, especially a recycler, a stabilizer or a cold milling machine, comprising such a spraying device and a method for operating such a spraying device.

15 Claims, 6 Drawing Sheets

(58) Field of Classification Search
USPC ..... 239/722, 754
See application file for complete search history.

(56) References Cited

U.S. PATENT DOCUMENTS

| | | | | |
|---|---|---|---|---|
| 3,966,544 | A * | 6/1976 | Johnson | D21F 1/34 162/199 |
| 4,990,025 | A * | 2/1991 | Young | E01C 21/00 404/92 |
| 5,279,500 | A | 1/1994 | Perrin et al. | |
| 5,385,426 | A | 1/1995 | Omann | |
| 5,895,173 | A | 4/1999 | O'Brien et al. | |
| 5,911,362 | A | 6/1999 | Wood et al. | |
| 6,565,281 | B2 | 5/2003 | Bruns et al. | |
| 6,802,464 | B2 | 10/2004 | Marconnet | |
| 2003/0194273 | A1* | 10/2003 | Lloyd | E01C 23/065 404/83 |
| 2005/0168048 | A1 | 8/2005 | Gaertner et al. | |
| 2008/0129103 | A1 | 6/2008 | Hall et al. | |
| 2008/0193215 | A1 | 8/2008 | Rath | |
| 2009/0052987 | A1 | 2/2009 | Hall et al. | |
| 2013/0114367 | A1 | 5/2013 | Heusinger et al. | |

FOREIGN PATENT DOCUMENTS

| | | | |
|---|---|---|---|
| DE | 10213017 | A1 | 10/2003 |
| DE | 10241067 | B3 | 4/2004 |
| DE | 102010013982 | A1 | 10/2011 |
| EP | 0860551 | A2 | 8/1998 |
| EP | 0960239 | A1 | 12/1999 |

OTHER PUBLICATIONS

Espacenet, English Machine Translation of German Application No. DE10213017A1, published Oct. 9, 2003, retrieved from http://worldwide.espacenet.com on Mar. 28, 2014 (9 pages).

Espacenet, English Machine Translation of German Application No. DE10241067B3, published Apr. 22, 2004, retrieved from http://worldwide.espacenet.com on Mar. 28, 2014 (9 pages).

European Patent Office, European Search Report, Application No. 11004500.2, dated May 7, 2012 (9 pages).

State Intellectual Property Office of the People's Republic of China, English Machine Translation of Notification of the First Office Action, Application No. 201110092819.1, dated Sep. 23, 2014 (7 pages).

German Patent Office, Office Action, Application No. 10 2010 014 904.7, dated Oct. 13, 2014 (5 pages).

Espacenet, English Machine Translation of CN201082956Y, published Jul. 9, 2008, retrieved from http://worldwide.espacenet.com on Nov. 6, 2014 (6 pages).

* cited by examiner

SPRAYING DEVICE FOR A CONSTRUCTION MACHINE FOR PROCESSING THE GROUND, A CONSTRUCTION MACHINE WITH A SPRAYING DEVICE AND A METHOD FOR OPERATING A SPRAYING DEVICE

CROSS REFERENCE TO RELATED APPLICATIONS

The present application is a Continuation application of U.S. Ser. No. 13/209,532, filed Aug. 15, 2011, which claims priority under 35 U.S.C. § 119 of German Patent Application No. 10 2010 035 129.6, filed Aug. 23, 2010, the disclosures of which are hereby incorporated herein by reference in their entireties.

FIELD OF THE INVENTION

The present invention relates to a spraying device for a construction machine for processing the ground, a construction machine with such a spraying device and a method for operating a spraying device.

BACKGROUND OF THE INVENTION

Many construction machines, especially construction machines for processing the ground or roads such as a cold milling machine for milling off road or ground surfaces, a stabilizer for stabilizing ground of low bearing capacity, and a recycler for repairing road pavements in need of repair, comprise spraying devices in order to reduce the development of dust during the working process and/or add fluid, especially water, to the ground material to be processed in order to obtain desired properties. Such construction machines are usually provided with a working roller with which the ground or the road can be broken up and/or be thoroughly mixed. If the processing comprises an asphalt or concrete road surface, a typical process is milling off the road surface. The working roller is mounted with respect to its cylindrical axis directly or indirectly horizontally on a machine frame of the construction machine and extends transversely to the longitudinal direction and the working direction of the construction machine. The working roller is further usually mounted in a working chamber which is open towards the ground, in which the working roller rotates in operation and comes into contact with the ground to be processed. The working roller is usually shielded off towards the other sides, e.g., by a protective hood or a milling roller box. As a result of the enclosed configuration of the working chamber, it is prevented among other things that the material milled off by the working roller rotating about its longitudinal axis will be ejected in an uncontrollable manner into the ambient environment of the construction machine. The outwardly delimited working chamber is further used for the transport of material in order to enable the controlled removal of material milled off by the milling roller. It is the object of the working chamber in another application to provide a mixing space in which the processed raw material can be mixed with an additive in order to achieve fortification or stabilization of the ground for example. Typical additives in this connection are hydraulic or bituminous bonding agents or water for example.

In order to enable adding a fluid to the working chamber in working operation, the construction machine comprises a spraying device. The spraying device usually comprises a fluid delivery apparatus, by means of which the fluid can be introduced into the working chamber. Such a fluid delivery apparatus can be a valve for example and comprise an outlet opening or an outlet nozzle opening into the working chamber. Frequently, the part of the fluid delivery apparatus via which the fluid enters the working chamber is arranged in the interior of the working chamber. The term of fluid delivery apparatus shall comprise all such means in the following which are provided for direct delivery of the fluid into the working chamber. This therefore concerns at least one suitable fluid outlet opening, e.g., an opening of a nozzle. The fluid delivery apparatus further frequently comprises a valve or a comparable regulation means. It is not mandatory that it forms an integral unit with the at least one fluid outlet opening. The relevant aspect is that the regulation means can regulate the fluid flow through the outlet opening, e.g., it can release or block the same. Furthermore, a line system is present by which the fluid is guided to the fluid delivery apparatus. The line system can optionally comprise further components such as one or several pumps via which the fluid is pumped from the storage reservoir to the line system and finally to at least one outlet nozzle, filter, valves, etc. The supply of the construction machine with fluid occurs either via one or several separately provided fluid tanks and/or by a connection of the construction machine with a suitable tank vehicle. In addition, the construction machine can be arranged for supplying the working chamber with different fluids or a fluid mixture. For this purpose, several fluid tanks can be integrated in the construction machine or suitable connections for a tank vehicle can be provided.

The fluid quantity or the flow quantity of fluid which is to be added to the ground material to be processed can vary widely depending on the respective application. A generic spraying device therefore further comprises a control unit which controls the fluid supply through the line system up to the fluid delivery apparatus. The control unit thus represents the central open-loop and closed-loop control component of the spraying device and is responsible for controlling the spraying device and the individual components of the spraying device. The control device can specifically comprise a respectively programmed microcontroller which triggers the respective components of the spraying device via suitable signal connections. The control unit can further comprise an input unit via which the machine operator can enter control parameters such as ground condition, feed line of the spraying device, type of fluid, etc. Typical control functions which are controlled by the control unit are the activation and deactivation of the fluid supply for example or a respective pump, the regulation of the fluid pressure or the delivered fluid quantity per unit of time which is output by the fluid delivery apparatus, or the flow quantity, the type of fluid, etc.

A typical application in which the introduction of a fluid into the working chamber of the construction machine is desired is the mixture of the material processed by the working roller in the working chamber with water in order to achieve improved material properties of the ground material together with bonding agents such as lime for example which was previously applied to the ground to be processed. Alternatively, or in addition, a reduction in the development of dust in working operation can be achieved by wetting the ground material. Further exemplary applications are the introduction of bituminous bonding agents, the production and introduction of foamed bitumen, etc.

The required fluid quantities can vary widely depending on the conditions of the respective application. In the case of recycling applications, a comparatively low amount of water (e.g., approximately 100 to 300 L/min) is frequently required, whereas up to 700 to 1000 L/min are conveyed by the spraying device into the working chamber in the case of stabilization applications for example. In the case of the conventional spraying devices, considerable fluctuations in pressure and insufficient precision in dosing and an even distribution of the fluid in the working chamber is therefore obtained over the entire application spectrum. Especially in the case of low pressures there are frequently uneven and thus unsatisfactory distribution results in conventional spraying devices. Moreover, there is a likelihood especially at low pressures that the fluid delivery apparatus will clog with the ground material to be processed and will therefore not be available for further use.

It is therefore the object of the present invention to provide a spraying device for a generic construction machine which continuously and reliably ensures the even introduction of a fluid into the working chamber over a wide conveying range, i.e., from low fluid quantities up to comparatively high fluid quantities per unit of time and/or distance. Moreover, the spraying device shall be robust and fail-safe.

SUMMARY OF THE INVENTION

It is provided in accordance with one embodiment of the present invention that the spraying device for introducing a fluid into the working chamber of the construction machine for processing grounds of roads comprises at least one first and at least one second fluid delivery apparatus, by means of which the fluid can be introduced into the working chamber. The first fluid delivery apparatus is arranged for delivering a larger fluid quantity than the second fluid delivery apparatus at a fixed operating pressure. The fixed operating pressure is therefore a specific pressure in the operation of the spraying device, e.g., in the line system before the at least first and the at least second fluid delivery apparatus or a specific section in the line system. Under this comparative pressure the at least first and the at least second fluid delivery apparatus supply different fluid quantities to the working chamber. With respect to this comparative pressure, the at least first fluid delivery apparatus is thus more powerful than the at least second fluid delivery apparatus and supplies a larger fluid volume per unit of time to the working chamber at the same operating pressure than the at least second fluid delivery apparatus. It is understood that the operating pressure which is relevant here prevails only at such points in the spraying device where the fluid pressure changes depending on the fluid quantity conveyed in the line system or rises with rising delivery volume and vice versa. For this purpose, the fluid pressure in the line system between the pump and the at least first and the at least second fluid delivery apparatus is used. The relevant aspect for the arrangement of the spraying device in accordance with one aspect of the present invention is that the spraying device comprises at least two fluid delivery apparatuses which differ from one another in their performance. The "large" fluid delivery apparatus allows delivering a substantially larger fluid volume to the working chamber at the specific operating pressure of one bar for example than the "smaller" second fluid delivery apparatus at this specific operating pressure. It is understood that both fluid delivery apparatuses will deliver more fluid to the working chamber when the operating pressure is increased. However, a larger volume at a comparable operating pressure will always flow through the larger first fluid delivery apparatus. In other words, the spraying device in accordance with one aspect of the present invention therefore comprises a "high-performance fluid delivery apparatus" for supplying a large fluid volume per unit of time to the working chamber and a "low-performance fluid delivery apparatus" for lower fluid deliveries per unit of time to the working chamber in comparison with the high-performance fluid delivery apparatus. As a result, in a smaller range of the operating pressure it is therefore possible to reliably cover an especially wide spectrum or an especially wide range of fluid volume per unit of time that can be metered to the working chamber. If the delivery of an only low fluid quantity is required, the introduction of the fluid into the working chamber preferably occurs by way of the second fluid delivery apparatus, and in the case of a higher fluid demand via the first fluid delivery apparatus or even via the at least two fluid delivery apparatuses. Since the first fluid delivery apparatus is arranged in the manner that it delivers a larger fluid quantity than the second fluid delivery apparatus at a fixed operating pressure, the spraying device is capable of introducing highly varying volumes of fluid in a homogeneously distributed manner into the working chamber in a comparatively narrow operating pressure range.

A further important component of the spraying device in accordance with one aspect of the present invention is the line system, by means of which the fluid is guided to the at least first and to the at least second fluid delivery apparatus. The line system comprises all line parts ranging from the fluid tank or fluid input of the construction machine right up to the respective fluid delivery apparatus. In summary, it is the object of the line system to forward the fluid from the feed or storage area up to the fluid delivery apparatus. Typical components of the line system can be pipelines, hoses, valves, one or several pumps, filter units, line beams, etc.

One important element of the spraying device in accordance with the present invention is represented by the control unit which is arranged for controlling the fluid delivery via the at least first and the at least second fluid delivery apparatus. The control unit controls the fluid delivery of the at least first and the at least second fluid delivery apparatus in the manner that it triggers the first fluid delivery apparatus and the second fluid delivery apparatus separately or individually, or both together, as will be explained below in closer detail. Individual triggering shall especially also be understood to be a merely partial activation of one of the at least first or at least second fluid delivery apparatuses, depending on the embodiment. The control unit therefore controls the at least first and the at least second fluid delivery apparatus independently from one another. It is understood that it is also possible that in addition to the at least first and the at least second fluid delivery apparatus there are further fluid delivery apparatuses which are also triggered separately by the control unit. The control unit can be arranged to be self-regulating. In this embodiment, reference values are predetermined by the operator. The control unit determines and controls the required flow rate on the basis of these reference values. Typical parameters which can be considered by the control unit are the desired fluid distribution or humidity in the ground material to be processed, the milling depth, the density of the ground, the travelling speed, etc. If the milling depth is changed in ongoing operation in this embodiment, e.g., it is increased for example, the control unit simultaneously respectively increases the flow rate of the fluid or the volume of the fluid introduced into the working chamber per unit of time, so that despite different milling depths the quantity of fluid introduced into the ground remains constant per volume of ground material.

Each fluid delivery apparatus comprises at least one dosing element with which the fluid is delivered directly into the working chamber and is especially sprayed into the same. Such dosing elements can be holes for example in a line beam which can be opened and closed via a respective valve or which can be supplied with fluid in a dosed manner. Preferably, the dosing elements comprise, in one embodiment, outlet nozzles because an especially homogeneous distribution of the fluid can be achieved in the working chamber via the outlet nozzles. A dosing element is therefore a sub-unit of the fluid delivery apparatus and relates exclusively to the component which is responsible in the last step of the fluid conveyance for the introduction of the fluid into the working chamber. In other words, the dosing element is the element by means of which the fluid enters the working chamber via the spraying device. The fluid delivery apparatus can further comprise at least one regulation element such as a valve which is triggered for activation, deactivation and regulation of the flow rate by the control unit.

The concrete arrangement of the dosing elements can also vary. The individual dosing elements of a fluid delivery apparatus are preferably arranged in an evenly distributed manner parallel to the longitudinal axis of the working roller one after the other in the axial direction over the entire width of the working chamber. This ensures that the fluid introduction into the working chamber occurs as evenly as possible over the entire width of the working chamber. The at least first and the at least second fluid delivery apparatus frequently comprises several dosing elements, especially outlet nozzles, e.g., 3 to 20, especially 8 to 15 and in particular 10. The specific arrangement of the at least first fluid delivery apparatus relative to the at least second fluid delivery apparatus can also vary. It is therefore possible for example that each of the at least first fluid delivery apparatus is arranged before or behind a dosing element, especially an outlet nozzle, of the at least second fluid delivery apparatus in the rotational direction of the working roller or in the working direction of the construction machine. It is especially preferable in one embodiment for this alternative arrangement that the number of the dosing elements of the at least first fluid delivery apparatus and the at least second fluid delivery apparatus is the same, and both fluid delivery apparatuses therefore comprise ten dosing elements each for example, especially outlet nozzles. It is alternatively possible that the dosing elements of the at least first and the at least second fluid delivery apparatus are arranged in an alternating manner in the axial direction of the working roller adjacent to one another over the entire width of the working chamber distributed as evenly as possible, especially on a common part of the line system such as a line beam for example. In particular, unequal numbers of dosing elements of the at least first and the at least second fluid delivery apparatus have proven to be advantageous especially for this embodiment in order to ensure homogeneity of the fluid introduction. As a result, the number of the dosing elements of the one fluid delivery apparatus exceeds that of the other one by one dosing element, so that one dosing element each of a fluid delivery apparatus is provided at the two outsides in the axial direction of the longitudinal axis. A symmetric arrangement of the dosing elements is further preferred. In order to increase the application variability of the spraying device, the individual dosing elements are further preferably arranged to be exchangeable. Screw-in nozzles are specifically used for this purpose for example, which can be replaced by nozzles of another size if required. The arrangement of the line system to the at least first or at least second fluid delivery apparatus can also vary. It is therefore possible for example that one separate line section, such as a separate line beam, is provided in the line system for the individual dosing elements of the at least first fluid delivery apparatus and for the individual dosing elements of the at least second fluid delivery apparatus. It is preferable, however, in one embodiment if the dosing elements of the at least first and the at least second fluid delivery apparatus are connected via a common element to the line system, e.g., a line beam. Both fluid delivery apparatuses therefore supply the same fluid to the working chamber and comprise a mutually adjacent and especially partly overlapping operating range concerning the flow volume or delivery volume of the fluid into the working chamber per unit of time.

The amount to which the first fluid delivery apparatus and the second fluid delivery apparatus differ from one another concerning the delivered fluid quantity at a fixed operating pressure depends substantially on the application spectrum of the construction machine which is equipped with such a spraying device. It has been noticed in practical operation that the dosing elements of the at least first and the at least second fluid delivery apparatus are preferably arranged in the manner that at the fixed operating pressure the flow rate of the fluid through a dosing element of the first fluid delivery apparatus in relation to the flow rate of the fluid through a dosing element of the second fluid delivery apparatus is in a range of 1.8:1 to 5:1, especially in the range of 2:1 to 3:1. In a preferred embodiment, the outlet nozzles of the first fluid delivery apparatus are dimensioned in such a way that they deliver approximately 25 L/min at operating pressure of one bar, and the outlet nozzles of the second fluid delivery apparatus are dimensioned in such a way that they spray approximately 10 L/min into the working chamber at an operating pressure of one bar. If the dosing elements of the fluid delivery apparatus are chosen in this ratio, it is ensured that the construction machine can be used especially over the entire range of typical recycler and stabilizer applications.

The control unit is arranged in such a way, for example, that it jointly triggers the respective dosing elements, especially the at least two dosing elements of the first and the second fluid delivery apparatus. If the first fluid delivery apparatus is activated, the fluid is thus conveyed through all dosing elements of the first fluid delivery apparatus into the working chamber. The same applies to the dosing elements of the second fluid delivery apparatus. An especially high application versatility is enabled if the control unit is arranged in the manner that it triggers the at least two dosing elements of the at least first fluid delivery apparatus and/or the at least second fluid delivery apparatus in a grouped manner and especially individually. In the case of individual triggering, it is thus possible to activate individual dosing elements of the first and second fluid delivery apparatus separately. This obviously also includes the possibility to activate several or all dosing elements of the fluid delivery apparatus simultaneously or to use them for the delivery of fluid into the working chamber. With reference to the entire working chamber, this exemplary embodiment offers the possibility of introducing fluid into the ground material to be processed merely in partial areas of the working chamber. This may be desirable in working operation when merely a partial area of the processing width of the construction machine extending in the travelling direction of the construction machine is to be provided with fluid. It is necessary for this kind of spraying device that each dosing element is provided with a respective device such as a valve, for example, which can be triggered or controlled by the control unit. The at least first and/or at least second fluid delivery apparatus is therefore relatively expensive in production. A useful and thus also advantageous compromise is represented by a spraying device according to a further embodiment of the present invention, in which the control unit is arranged in the manner that it triggers the dosing elements of the at least first fluid delivery apparatus and/or the at least second fluid delivery apparatus in a grouped manner. At least two dosing element each form a dosing element group for example. Dosing elements of the at least first and/or the at least second fluid delivery apparatus are arranged in this embodiment at least partly in groups within the scope of the fluid delivery apparatus, so that a dosing element group, especially two dosing elements, can be activated with one valve. It is understood that the number of the individual dosing elements can vary for each group and can be adjusted to the respective requirements.

Principally, the control unit can be arranged in the manner that it automatically controls the at least first and the at least second fluid delivery apparatus in the manner that a fixed fluid volume per unit of time is delivered to the working chamber or the flow rate of fluid to the working chamber is kept constant. Depending on the configuration of the ground (especially the ground density), the ambient situation on the construction site, the work settings such as milling depth, travelling speed, etc., the desired fluid volume per unit of time or the flow rate of the fluid unit of time into the working chamber can vary strongly. Moreover, different fluids can have different viscosities for example, which requires taking different operating pressures into account for obtaining a desired fluid flow into the working chamber. Further parameters can additionally occur which have a direct or indirect influence on the conveyed quantity of the fluid or the fluid throughput of the ground to be processed. In order to still ensure constant working results, the present invention proposes in a further aspect to arrange the control unit in the manner that switches over from the at least first fluid delivery apparatus to the at least second fluid apparatus and vice versa depending on exceeding or falling short of a threshold value. The relevant principal idea of this embodiment is that the control unit automatically controls the delivered quantity of fluid into the working chamber on the basis of at least one relevant measuring parameter and controls the fluid quantity introduced into the working chamber per unit of time depending on this measuring parameter. At least one threshold value is stored in the control unit for this purpose, which triggers a changeover from the at least second fluid delivery apparatus to the more powerful at least first fluid delivery apparatus when said threshold value is exceeded. Such a threshold value can be flow rate, the line pressure, etc. It is understood that several threshold values can also be provided which will each trigger a changeover when exceeded. It can thus be ensured that the fluid quantity introduced into the working chamber can be varied in a relatively wide range and the operating pressure is simultaneously kept within a comparatively narrow range. If on the other hand the threshold value is not reached, the control unit will respond in the opposite direction and will change over from the at least first fluid delivery apparatus to the at least second fluid delivery apparatus. The at least first fluid delivery apparatus is deactivated accordingly and the at least second fluid delivery apparatus is activated by the control unit. It is thus possible to keep the operating pressure within a significant range despite a potential drastic reduction of the fluid volume introduced into the working chamber per unit of time and to prevent an excessive drop in the operating pressure. As a result, an even distribution of the fluid over the entire fluid delivery apparatus is ensured on the one hand and clogging of the dosing elements and especially the outlet nozzles with the ground material of the respected fluid delivery apparatus can effectively be counteracted simultaneously on the other hand because the fluid will leave the dosing elements with a specific minimum pressure even at a lower volume flow.

It is understood that the control unit can also be arranged in the manner that it will automatically activate at least one of the at least two fluid delivery apparatuses of the at least other fluid delivery apparatus depending on exceeding or falling short of a maximum value. This typically occurs for example whenever the more powerful at least first fluid delivery apparatus has reached its spraying maximum in respect of fluid volume per unit of time or the flow rate. The delivery rate of the spraying apparatus can additionally be increased according to this further embodiment in that the weaker at least second fluid delivery apparatus is activated in addition to the more powerful fluid delivery apparatus or is virtually added to the same. This occurs automatically in this embodiment if the maximum value of a suitable control parameter stored in the control unit and/or the maximum flow rate is exceeded. This can be the line pressure in the live system of the spraying device, the flow rate or the delivery volume per unit of time into the working chamber or the like. It is understood that for monitoring the maximum value and also the previously mentioned threshold value at least one respectively suitable sensor device needs to be integrated as part of the control device in the spraying device such as a pressure sensor which determines the fluid pressure in the line system and sends this to the control unit. If the maximum value is not reached, the weaker at least second fluid delivery apparatus is deactivated at first by the control unit. If the respective parameter drops further and then falls short of the threshold value, the control unit switches over from the more powerful at least first fluid delivery apparatus to the weaker at least second fluid delivery apparatus.

Principally, a large number of operating parameters are suitable for defining and determining the threshold value and/or the maximum value. The monitoring and determination of the line pressure, the flow rate of fluid per unit of time, the milling depth, the ground humidity, the ground density and/or the travelling speed are especially preferred in this context. It is obviously also possible to use combinations of parameters for monitoring and controlling the spraying device. For example, the line pressure can be considered by a respectively arranged control unit in addition to the travelling speed and/or in addition to the flow rate of fluid a unit of time.

The most widely used fluid is water. Applications are also known where there are changes between different fluids. These fluids frequently have large differences concerning their specific properties such as their viscosity for example. It is advantageous in these cases if the control unit is arranged in the manner that threshold value and/or the maximum value vary depending on the respected fluid or are adjusted to the specific properties of the fluid. Individual threshold values and/or maximum values are stored in the control unit for each fluid in this embodiment.

By using at least two fluid delivery apparatuses which are arranged differently with respect to their delivery quantity at a fixed operating pressure or comparative pressure it is possible to substantially reduce the clogging of dosing elements, especially the outlet nozzles, with clogging ground material in working operation. In the event that especially critical ground materials need to be processed, in this respect it is further preferable that a cleaning device or cleaning function, especially a nozzle cleaning device, is provided for cleaning the at least first and the at least second fluid delivery apparatus. It can be arranged in the manner for example that the control unit for performing the cleaning function triggers a cleaning pulse in regular intervals by the respectively provided fluid delivery apparatuses.

A further development further provides integration of a fluid filter in the line system, especially in the conveying direction of the fluid before and/or behind a fluid pump. It can thus be ensured that the fluid conveyed to the at least first and the at least second fluid delivery apparatus is free from any dirt. In summary, accumulation of dirt and clogging in the line system can be better prevented. It is naturally also possible to integrate several pumps in the line system in order to convey fluid with separate pumps to the at least first and the at least second fluid delivery apparatus and/or to provide a separate line system for each fluid.

The object is further achieved by a construction machine for processing ground, especially a recycler for repairing road pavements in need of repair, a stabilizer for stabilizing ground of low bearing capacity, and a milling machine, especially a cold milling machine, for milling off the surfaces of roads and ground with a spraying device arranged in a manner as described above. These different types of construction machines correspond to one another in respect of the substantial arrangement of the working tool and the arrangement of this working tool in the construction machine. They all comprise a working roller which is arranged horizontally and transversely to the longitudinal axis or working direction of the construction machine, which working roller is arranged to rotate around its horizontal axis for processing ground, e.g., for milling off road surfaces, stabilizing ground or recycling defective road pavements. The working chamber, in which the working roller is arranged in a rotating manner, is provided with a substantially enclosed arrangement towards the sides and above, e.g., with a cover or protective hood, so that the working chamber is merely opened towards the ground and can be used for thoroughly mixing the ground to be processed with aggregates and/or fluids, etc. The working device or working roller is arranged directly or indirectly on the frame of the construction machine. The construction machine is further arranged in a self-propelled manner and comprises at least one front wheel and at least two rear wheels which can be provided with a suitable drive such as respective hydraulic motors. Embodiments with respective crawler tracks are alternatively also possible. The construction machine can further comprise at least one fluid storage reservoir for carrying the fluid for fluid supply or can be connected alternatively via the line system with a tank vehicle or the like for supplying the spraying device with fluid. The present invention provides that the spraying device as described above be integrated in a construction machine for processing ground, especially a construction machine with the features as described above.

The object is finally also achieved with a method for operating a spraying device, especially the spraying device of the construction machine as described above. The method in accordance with one embodiment of the present invention provides a regulation of the flow rate of the spraying device by triggering at least one first fluid delivery apparatus and at least one second fluid delivery apparatus by a control unit, with the first fluid delivery apparatus being arranged in the manner that it is arranged for supplying a larger fluid quantity than the second fluid delivery apparatus at a fixed operating pressure. The method in accordance with one aspect of the present invention is therefore characterized in that for supplying the same fluid into the working chamber at least two fluid delivery apparatuses which are arranged in a different way with respect to one another concerning their respective performance at a fixed comparative operating pressure are triggered by the control unit and are controlled with respect to the fluid quantity delivered to the working chamber. As a result, the operating pressure in the line system of the spraying device can be kept within a comparatively narrow margin and the fluid quantity delivered to the working chamber per unit of time can simultaneously be varied within a wide margin.

A further development of the method in accordance with one aspect of the present invention provides the regulation of the flow rate of the spraying device or the delivery of the fluid volume per unit of time to the working chamber depending on exceeding and/or falling short of at least one fixed threshold value of at least one specific operating parameter. The control unit thus switches automatically from the activated less powerful at least second fluid delivery apparatus to the more powerful at least first fluid delivery apparatus if the flow rate of the fluid per unit of time and/or the operating pressure in the line system exceeds the threshold value. A similar control process can be executed for example if the travelling speed of the construction machine or the line pressure exceeds the threshold value as a result of acceleration of the machine in order to keep constant the fluid introduction per volume unit of ground material. It is naturally also possible to integrate combinations of different operating parameters in the control unit for determining a threshold value and for determining the current operating state of the construction machine. It is possible for example to determine the threshold value by taking into account the operating pressure, the milling depth and/or the travelling speed of the construction machine simultaneously and to control the changeover between the at least first fluid delivery apparatus and the at least second fluid delivery apparatus both depending on the operating pressure in the line system and/or the milling depth and/or the travelling speed of the construction machine.

The changeover between the at least first and the at least second fluid delivery apparatus can principally occur in a continuous manner. This means that the at least first fluid delivery apparatus is deactivated at the time at which the second fluid delivery apparatus is activated, and vice versa. However, relatively large pressure fluctuations can occur in the line system in this changeover process. In order to prevent the pressure peaks from occurring during the changeover, the present invention therefore proposes, in one embodiment, that the changeover between the at least first and the at least second fluid delivery apparatus is performed in an overlapping manner. If changeover occurs by the control unit from the at least first fluid delivery apparatus to the at least second fluid delivery apparatus during a reduction of the travelling speed of the construction machine for example, there is a parallel activation of the at least second fluid delivery apparatus in the case of an activated at least first fluid delivery apparatus. After the expiration of a predetermined interval the at least first fluid delivery apparatus is finally deactivated and the supply of the fluid into the working chamber is continued by the at least second fluid delivery apparatus alone. This process is performed in a respectively reverse manner if the fluid quantity delivered to the working chamber per unit of time is to be increased. The relevant aspect for this performance of the method in accordance with the present invention is therefore that during the changeover the at least first and the at least second fluid delivery apparatus are activated simultaneously or in a temporally overlapping manner with respect to their activation state for a transitional period of time and they jointly deliver the fluid within this interval to the working chamber. After the expiration of this interval, the desired deactivation of the respective fluid delivery apparatus which is no longer required is performed. The occurrence of pressure peaks during the changeover is thus effectively prevented and the pressure load on the line system is considerably reduced.

BRIEF DESCRIPTION OF THE DRAWINGS

The present invention will be explained below by reference to several embodiments shown in the schematic drawings, wherein.

DETAILED DESCRIPTION OF THE INVENTION

Figure 1:
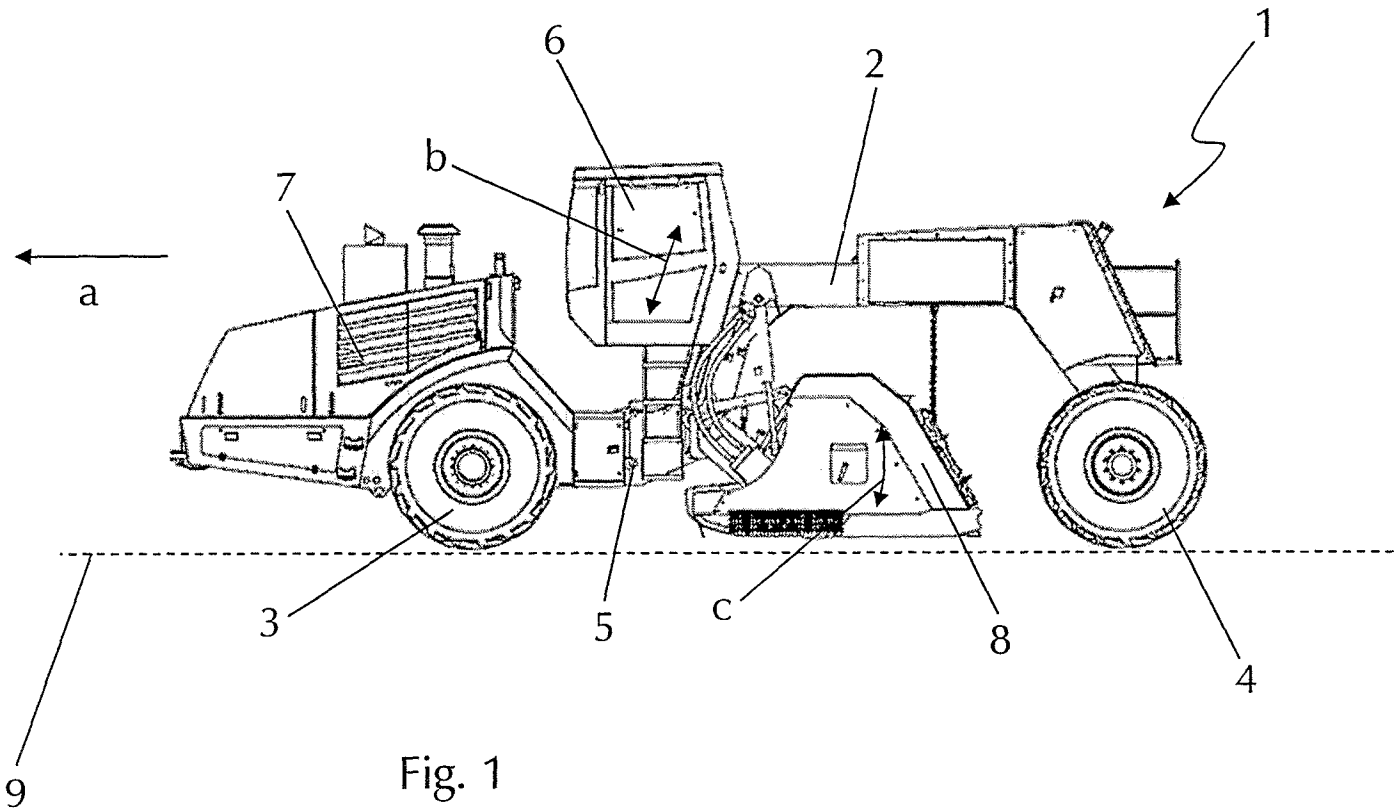
FIG. 1 shows a side view of a generic construction machine.

FIG. 1 relates to a construction machine 1, specifically in FIG. 1 a so-called stabilizer or a recycler, which depends on the respective application. The construction machine 1 comprises a machine frame 2, a pair of front wheels 3 and a pair of rear wheels 4, with merely the wheel disposed in the working direction a on the left side being visible. The machine frame 2 has a two-element configuration comprising two frame elements which are connected with each other by a knee-joint connection 5. A driver's cabin 6 is arranged at the level of the knee-joint connection 5, which cabin is height-adjustable along the direction of arrow b. The required drive power is provided by means of a drive apparatus 7 which provides the drive power required both for driving the construction machine 1 and for driving the working device which will be explained below in closer detail. The construction machine 1 is used for processing ground or road surfaces and the working device comprises a working roller for this purpose (not shown in FIG. 1). The working roller is mounted indirectly on the machine frame 2 of the construction machine 1 to be rotatable about its cylindrical axis and is enclosed by a protective hood 8 which encloses the working device upwardly and to the sides. The protective hood 8 is provided with an open configuration downwardly and towards the ground 9. The protective hood 8 thus encloses a working chamber in which the working roller is held. The working roller is height-adjustable in the direction of arrow c relative to the protective hood 8 and to the machine frame 2 and comprises a respective adjusting or pivoting apparatus for this purpose. In the position as shown in FIG. 1 the working roller is position upwardly and is not in contact with the ground 9 to be processed. This position of the working roller is assumed for example in the transport mode of the construction machine 1, whereas the working roller is lowered downwardly in the working mode or ground processing mode and presses into the ground in the depth as desired. The construction machine is moved in the direction of arrow a (forward direction) over the ground 9.

Figure 2:
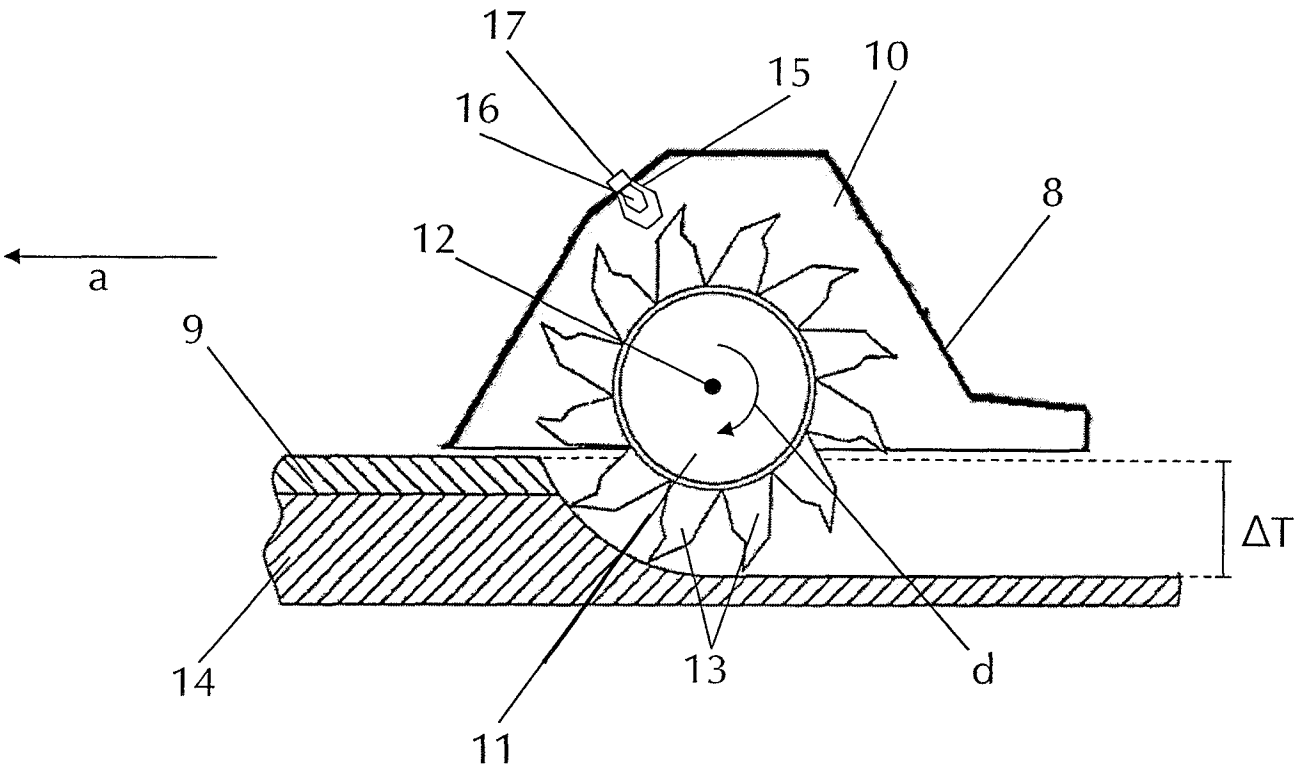
FIG. 2 shows a sectional side view into the working chamber of the construction machine of FIG. 1.

The concrete configuration of the working chamber 10 which is covered in a bell-like manner by the protective hood 8 is shown in closer detail in the sectional view of the protective hood 8 of FIG. 1 perpendicularly to the rotational axis of the working roller and in FIG. 2 in the working direction a. The protective hood 8 therefore encloses the working chamber 10 upwardly and towards the sides. The hood 8 is provided with an open arrangement in a downward direction and in the direction towards the ground 9 of the road, so that the working roller 11 which is enclosed by the hood 8 can be brought into contact with the ground 9 to be processed by lowering the working roller 11 in the direction of arrow c (FIG. 1). The working roller 11 is arranged in the interior of the protective hood 8. The longitudinal axis 12 of the working roller 11 extends horizontally and perpendicularly to the direction of movement a of the construction machine 1. A plurality of teeth 13 is arranged specifically by way of tool holder system or a tool-changing holder system (depending on the embodiment) on the outside of the cylindrical working roller 11. The working roller 11 rotates about its cylinder axis 12 in the direction of arrow d, i.e., in the opposite direction to the direction of movement of the construction machine 1. The working roller 11 thus removes ground material in the depth $\Delta T$, comprising the ground 9 of the road and a part of the underlying substructure 14 and deposits the same behind the working roller in the travelling direction a. The interior space disposed between the working roller and the protective hood 8 can be used as a mixing space.

For the purpose of introducing fluid, especially water, into the working chamber 10 which is delimited by the protective hood 8, an outlet nozzle 15 ("large" outlet nozzle) and an outlet nozzle 16 ("small" outlet nozzle) which is disposed in front of the former in the axial direction of the cylinder axis 12 protrude from the outside with their respective fluid outlet opening into the interior space of the working chamber 10. Both outlet nozzles 15 and 16 are each connected via a regulation element, which is specifically a respective valve (not indicated; valves will be indicated specifically below, wherein other suitable control elements can also be used), to a line beam 17 which is part of a line system. Further structurally identical outlet nozzles 15 and 16 are present which are arranged on the line beam 17 in an alternating manner in a direction of view behind the two outlet nozzles 15 and 16. Although it is principally also possible to use simple holes in the line beam instead of the outlet nozzles, the outlet nozzles are preferable however.

The line system further comprises a water reservoir which is mounted on the construction machine 1 (not shown in FIG. 2) and a pump (also not shown in FIG. 2) which conveys the water from the reservoir via the line system to the outlet nozzles 15 and 16. The pump is further arranged in the manner that it pressurizes the line system 17. When the respective valve of the large outlet nozzle 15 and/or the small outlet nozzle 16 is opened, the fluid arriving from the line beam 17 passes through the outlet nozzle 15 and/or the outlet nozzle 16 and thereby reaches the working chamber 10.

The outlet nozzle 15 is part of a first fluid delivery apparatus and the outlet nozzle 16 is part of a second fluid delivery apparatus. The principal configuration of the specific spraying device of FIG. 2 is explained in closer detail in the various embodiments in FIGS. 4 and 5. Two line beams 17.1 and 17.2 are arranged behind one another in the rotational direction in the embodiment of FIG. 3. Further details of the spraying device in different embodiments will be explained below in closer detail.

Figure 3:
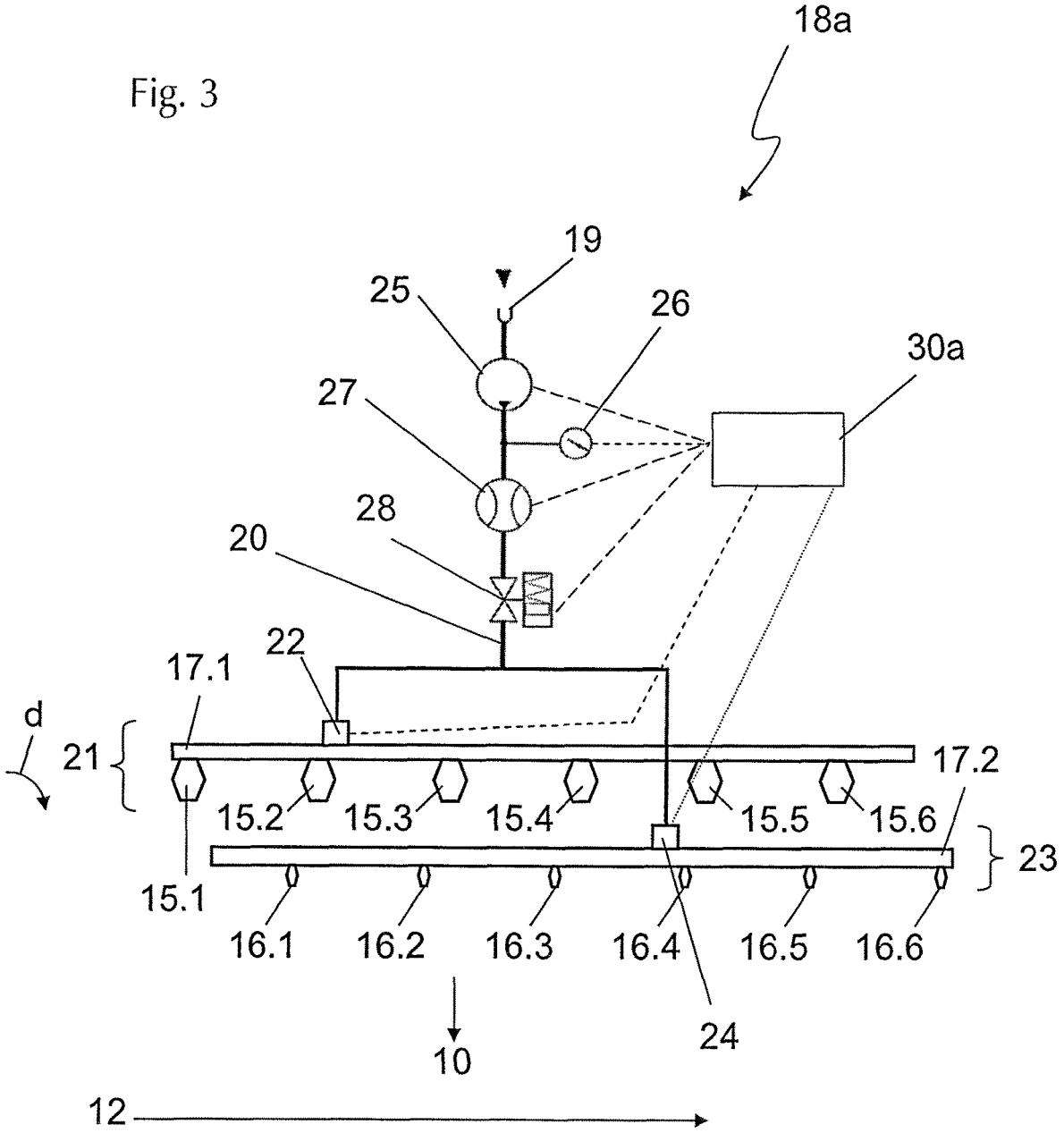
FIG. 3 shows the arrangement of a spraying device according to a first embodiment.

FIG. 3 relates to a spraying device 18*a* according to a first embodiment. The fluid, which is water in the present case, is conducted in the spraying device 18*a* from a feed point 19 which usually concerns a tanking connection or a connection to a tanker via a line system 20 to a first fluid delivery apparatus 21, comprising the large outlet nozzles 15.1 to 15.6 and the valve 22, and to a second fluid delivery apparatus 23, comprising the small outlet nozzles 16.1 to 16.6 and the valve 24. The line system 20 comprises a water pump 25, a pressure sensor 26, a flow meter 27 and a shut-off valve 28. Optionally, a filter 29 (in FIGS. 4 and 5) can further be integrated between the water pump 25 and the shut-off valve 28 in the set of lines of line system 20.

The line system 20 further comprises a first line beam 17.1 and a second line beam 17.2. The first line beam 17.1 is connected in a fluidic manner via the valve 22 of the first fluid delivery apparatus 21 with the remaining part of the line system 20. The six large outlet nozzles 15.1 to 15.6 are further arranged on the line beam 17.1 in parallel. Once the valve 22 is opened, the fluid flows through the portion of the line system upstream of the valve 22 (driven by the pump 25) through the valve 22 into the line beam 17.1, and is distributed there among the individual outlet nozzles 15.1 to 15.6 and passes through the outlet nozzles 15.1 to 15.6 into the working chamber 10. The outlet nozzles 15.1 to 15.6 are thus dosing elements of the first fluid delivery apparatus 21. The second fluid delivery apparatus 23 has a similar configuration. In this case, the small outlet nozzles 16.1 to 16.6 are connected to the second line beam 17.2 which is in connection with the remaining part of the line system 20 via the valve 24 of the second fluid delivery apparatus 23. Once the valve 24 is opened and pump 25 is in operation, fluid is pumped through the line system 20 and through the valve 24 into the line beam 17.2 and leaves the same to enter the working chamber 10 via the individual dosing elements of the second fluid delivery apparatus 23 or through the outlet nozzles 16.1 to 16.6 which are also switched in parallel with each other. The large outlet nozzles 15.1 to 15.6 concern outlet nozzles with a fluid output of 25 L per minute per nozzle into the working chamber at an operating pressure of one bar (measured with the pressure sensor 26 in the line system 20) and an output of 60 L per minute fluid into the working chamber per nozzle at an operating pressure of five bars. The small nozzles 16.1 to 16.6 are arranged in the manner however that they supply 10 L of fluid per minute to the working chamber for each nozzle at an operating pressure of one bar and 25 L per minute at an operating pressure of five bars. The large and small outlet nozzles 15.1 to 16.6 are thus chosen in relation to one another in such a way that their respective output volumes supplement one another in a virtually overlap-free manner at a specific operating pressure from 1 to 5 bars.

A further relevant element of the spraying device 18 is a control unit 30*a*. It is connected, as indicated by the broken and the dotted lines, with the pump 25, the pressure sensor 26, the flow meter 27, the shut-off valve 28, the valve 22 of the first fluid delivery apparatus 21 and the valve 24 of the second fluid delivery apparatus 23. The control unit 30 is arranged in the manner that it regulates and controls the output quantity of the fluid through the spraying device 18 and the first fluid delivery apparatus 21 and the second fluid delivery apparatus 23 into the working chamber 10. The control unit 30 is further arranged in the manner that it comprises an input field via which the operator can enter reference values, fluid properties, ground properties, etc., and general parameters relevant for the processing process. It is the principal idea of the present invention to arrange the spraying device 18 in the manner that it comprises at least two fluid delivery apparatuses (in the present case the first fluid delivery apparatus 21 and the second fluid delivery apparatus 23) with different output capacities concerning the flow rate of fluid per unit of time at a fixed operating pressure or comparative pressure and controls them in a manner adjusted to each other. If the introduction of large quantities of fluid into the working chamber 10 is desired, the control unit 30 opens the valve 22 of the first fluid delivery apparatus 21, so that in the present case 25 L of fluid per minute will be supplied per nozzle 25 to the working chamber 10 at an operating pressure of one bar for example in the line system 20. If on the other hand a lower fluid quantity is desired, the control unit 30 closes the valve 22 of the first fluid delivery apparatus 21, by means of which the introduction of fluid into the working chamber 10 through the large outlet nozzles 15.1 to 15.6 is deactivated. The control unit 30 opens the valve 24 of the second fluid delivery apparatus 23, so that the fluid will enter the working chamber 10 through the small outlet nozzles 16.1 to 16.3. If the operating pressure is one bar, 10 L of fluid per minute are introduced per nozzle into the working chamber. If the operating pressure is increased because the milling depth is increased for example and/or the working speed of the construction machine is increased, the control unit will switch over when reaching the threshold value of five bars from the second fluid delivery apparatus 23 with the small nozzles to the first fluid delivery apparatus 21 with the large nozzles and will lower the operating pressure accordingly, which occurs at first to one bar specifically in this case.

In summary, the control unit 30*a* can adjust the feedback control process for controlling the spraying device 18 by taking measuring parameters into account, e.g., the milling depth and/or the travelling speed of the construction machine in this specific example. As a result, the control unit 30 can detect the milling depth and/or the travelling speed of the construction machine or the processing speed by means of suitable sensors and adjust the fluid output or the flow rate fluid per unit of time by regulating the pump 25 and/or the valves 22 and 24 of the first fluid delivery apparatus 21 or the second fluid delivery apparatus 23 to the travelling speed of the construction machine. Other measuring parameters can be the operating pressure of the fluid in the line system 20, the applied output of the pump 25, etc., for example.

In order to obtain the maximum flow rate per unit of time of the spraying device 18 it is obviously also possible that the control unit activates both the first fluid delivery apparatus 21 and the second fluid delivery apparatus 23, so that fluid can be output simultaneously to the working chamber 10 through the outlet nozzles 15.1 to 15.6 and 16.1 to 16.6.

It is therefore principally possible with the help of the control unit 30*a* and the spraying device 18*a* of FIG. 3 in combination with relatively low pressure fluctuations in the operating pressure (between one bar and five bars in the present case for example) to cover the flow rate of the fluid over a large range of desired conveying volumes (in the present case between 10 L per minute at an operating pressure of one bar and activated second fluid delivery apparatus 23 and deactivated first fluid delivery apparatus 21 up to 85 L per minute at five bars and activated first fluid delivery apparatus 21 and simultaneously activated second fluid delivery apparatus 23). Since extreme pressure ranges in the line system can be excluded in this manner at least in regular operation, it is ensured for example that and even quantity of fluid will be output from each outlet nozzle 15.1 to 15.6 or, depending on the activation state, 16.1 to 16.6 into the working chamber. At the same time, a certain minimum pressure can be ensured in operation on the outlet nozzles 15.1 to 15.6 to 16.1 to 16.6 over a wide range, by means of which clogging of the respective outlet nozzles by ground material can effectively be counteracted.

Figure 4:
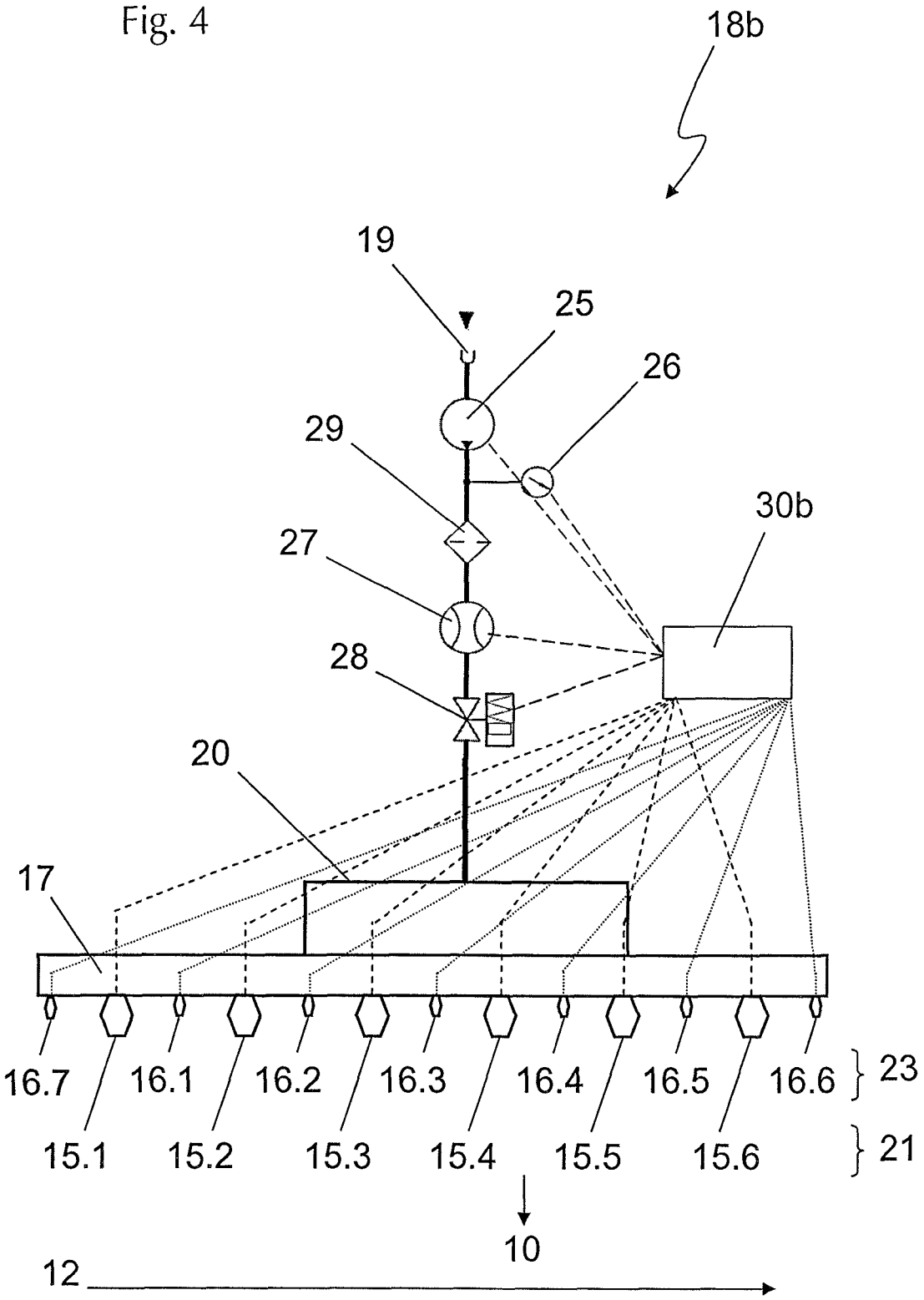
FIG. 4 shows the arrangement of a spraying device according to a second embodiment.

A further embodiment of a spraying device 18*b* is shown in FIG. 4. Reference is hereby made to the statements in respect of the preceding embodiment concerning the principal configuration of the line system 20 and the dosing elements arranged as the outlet nozzles 15.1 to 15.6 and 16.1 to 16.6. The second fluid delivery apparatus comprises an additional dosing element 16.7, and therefore comprises the number of dosing elements of the first fluid apparatus +1.

The relevant difference of the spraying device 18*b* in comparison with the spraying device 18*a* lies in the control of the large outlet nozzles 15.1 to 15.6 and the small outlet nozzles 16.1 to 16.7. In contrast to the preceding embodiment, the triggering of the individual outlet nozzles occurs in the present case individually and separate from one another, i.e., one by one, by the control unit 30*b*. Each of the dosing elements or outlet nozzles 15.1 to 15.6 and 16.1 to 16.7 comprises a respectively suitable valve which can be controlled and regulated by the control unit 30*b*, e.g., it can be opened and closed. The individual valves are not specifically stated in FIG. 4 for reasons of clarity of the illustration and are graphically a respective part of the respective outlet nozzle 15.1 to 15.6 and 16.1 to 16.7. The first fluid delivery apparatus 21 therefore comprises the totality of the individual large dosing elements or outlet nozzles 15.1 to 15.6, including their valves which are separately triggered by the control unit. The second fluid delivery apparatus 23 on the other hand designated the totality of the small dosing elements or outlet nozzles 16.1 to 16.7, including the valves which are not indicated separately in FIG. 4 and which are triggered by the control unit 30*b*.

It is a further particularity of the spraying device 18*b* that both the dosing elements of the first fluid delivery apparatus 21 (outlet nozzles 15.1 to 15.6) and also the dosing elements of the second fluid delivery apparatus 23 (dosing elements 16.1 to 16.7) are arranged jointly on the line beam 17. The need for space in the rotational direction of the working roller in the working chamber 10 in the protective hood of the spraying device 18*b* is thus essentially lower for example than the need for space of the spraying device 18*a* with the two line beams 17.1 and 17.2 which are disposed behind one another in the rotational direction d of the working roller.

It is further relevant in the spraying device 18*b* that individual dosing elements of the first fluid delivery apparatus 21 are distributed in an alternating manner in respect of the dosing elements of the second fluid delivery apparatus 23 over the entire length of the protective hood and are arranged to lie in one line in the axial direction of the rotational axis 12. The large outlet nozzles 15.1 to 15.6 thus alternate with the small outlet nozzles 16.1 to 16.7 in the axial direction 12 or transversely to the working direction of the construction machine in equal distances with respect to each other. If therefore all large outlet nozzles 15.1 to 15.6 and all small outlet nozzles 16.1 to 16.6 or even all outlet nozzles 15.1 to 15.6 and 16.1 610.6 are activated or are flowed through by fluid, the fluid will evenly distribute over the entire width of the working chamber 10. On the other hand, the individual triggering of individual outlet nozzles will enable the selective activation of a subgroup of the outlet nozzles 15.1 to 15.6 of the first fluid delivery apparatus 21 and/or the outlet nozzles 16.1 to 16.6 of the second fluid delivery apparatus 23. It is thus ensured that fluid is introduced into the working chamber 10 only over a part of the entire working width of the working roller 11. With reference to the entire working width, only a partial strip is supplied with fluid in working operation. In summary, the spraying device 18*b* therefore allows an exceptionally selective and individualized supply of fluid to the ground to be processed. It is further important that similar dosing elements 16.6 and 16.7 are arranged on the two outsides of the line beam 17 or in the axial direction of the working chamber (the direction in which the longitudinal axis 12 of the working roller extend in the working chamber). This feature also contributes to the homogeneous distribution of the fluid and the working chamber.

A further difference finally lies in the arrangement of a filter 29 in the line system 20. The filter 29 is arranged in the direction of flow of the fluid behind the pump 25 or between the pump 25 and the line beam 17 or the branching of the line system before the line beam 17.

Figure 5:
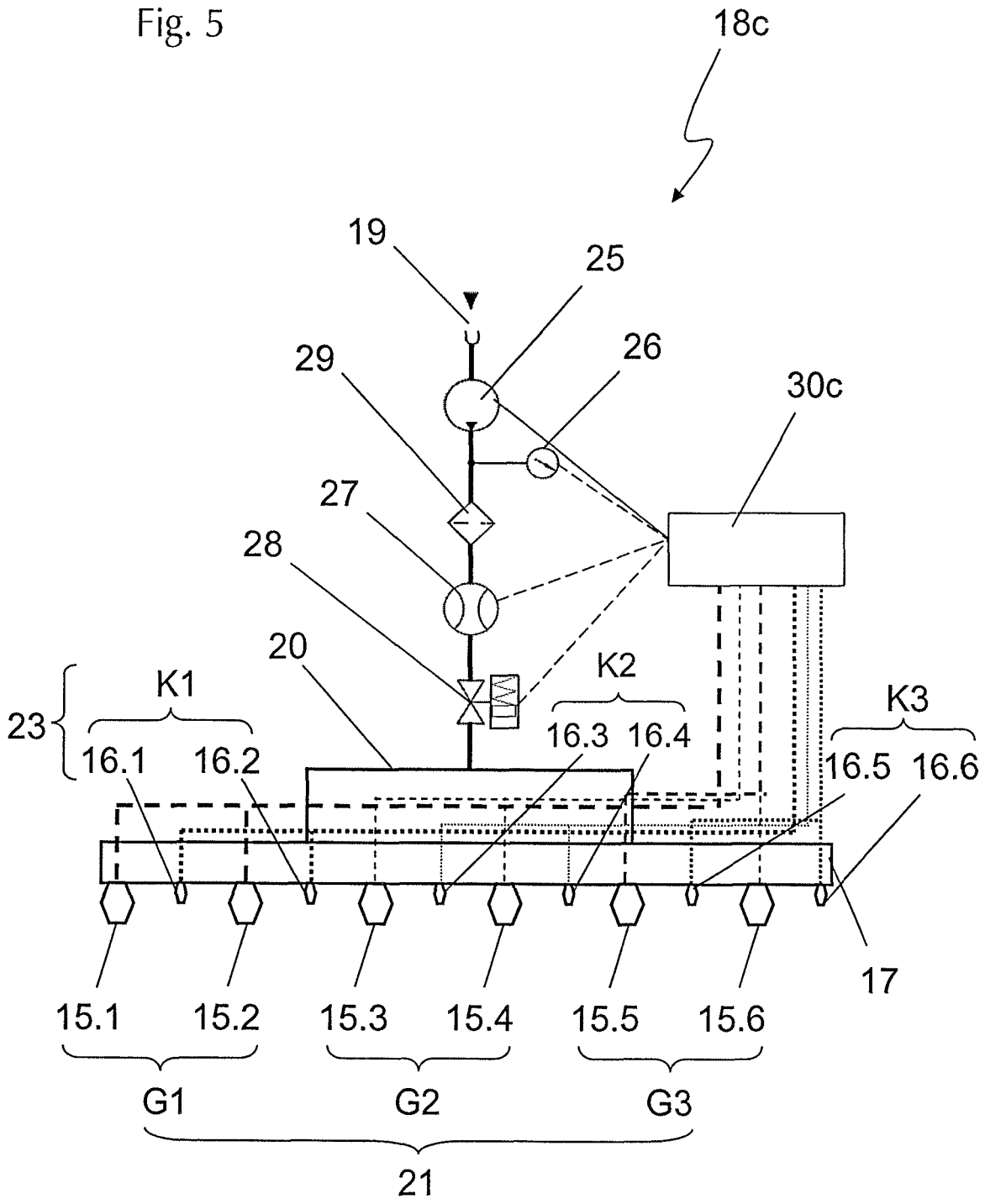
FIG. 5 shows the arrangement of a spraying device according to a third embodiment.

A further embodiment of a spraying device 18*c* is shown in FIG. 5, which represents an especially tried and tested compromise between the spraying device 18*a* and 18*b*.

The principal arrangement of the individual components of the spraying device 18*c* corresponds to that of the spraying device 18*b* (with the outer dosing element 16.7 missing in the spraying device 18*c*). The relevant difference is that the dosing elements 15.1 to 16.6 are switched in a grouped manner and are specifically grouped in pairs, and are triggered by the control unit 30*c*. As a result, the two outlet nozzles 15.1 and 15.2 form the dosing element group G1 for example, the outlet nozzles 15.3 and 15.4 the dosing element group G2, and the outlet nozzles 15.5 and 15.6 the dosing element group G3. The dosing element groups G1 to G3 (including the valves which are also not shown and are provided upstream of each outlet nozzle 15.1 to 15.6) jointly form the first fluid delivery apparatus 21. The dosing elements of the second fluid delivery apparatus 23 are also grouped in pairs. The outlet nozzles 16.1 and 16.2 form the dosing element group K1, the outlet nozzles 16.3 and 16.4 the dosing element group K2, and the outlet nozzles 16.5 16.6 dosing element group K3. The control unit 30*c* can now individually regulate and control the operating state of every single group G1, G2, G3, K1, K2 and K3 (indicated in FIG. 5 by the switching connections indicated in dotted and dashed lines of different thickness between the control unit 30*c* and the individual dosing elements 15.1 to 16.6). It is therefore also possible with the spraying device 18*c* to control individual segments of the first fluid delivery apparatus 21 and/or the second fluid delivery apparatus 23 individually and independent from one another concerning the operating state and the flow rate. At the same time, the switching of the control unit 30*c* with the individual fluid delivery apparatuses 21 and 23 can be simplified because it is not necessary that every single dosing element needs to be in contact with the control unit 30*c* via a single and individual signal connection, but merely the respective dosing element groups G1 to G3 and K1 to K3.

Figure 6:
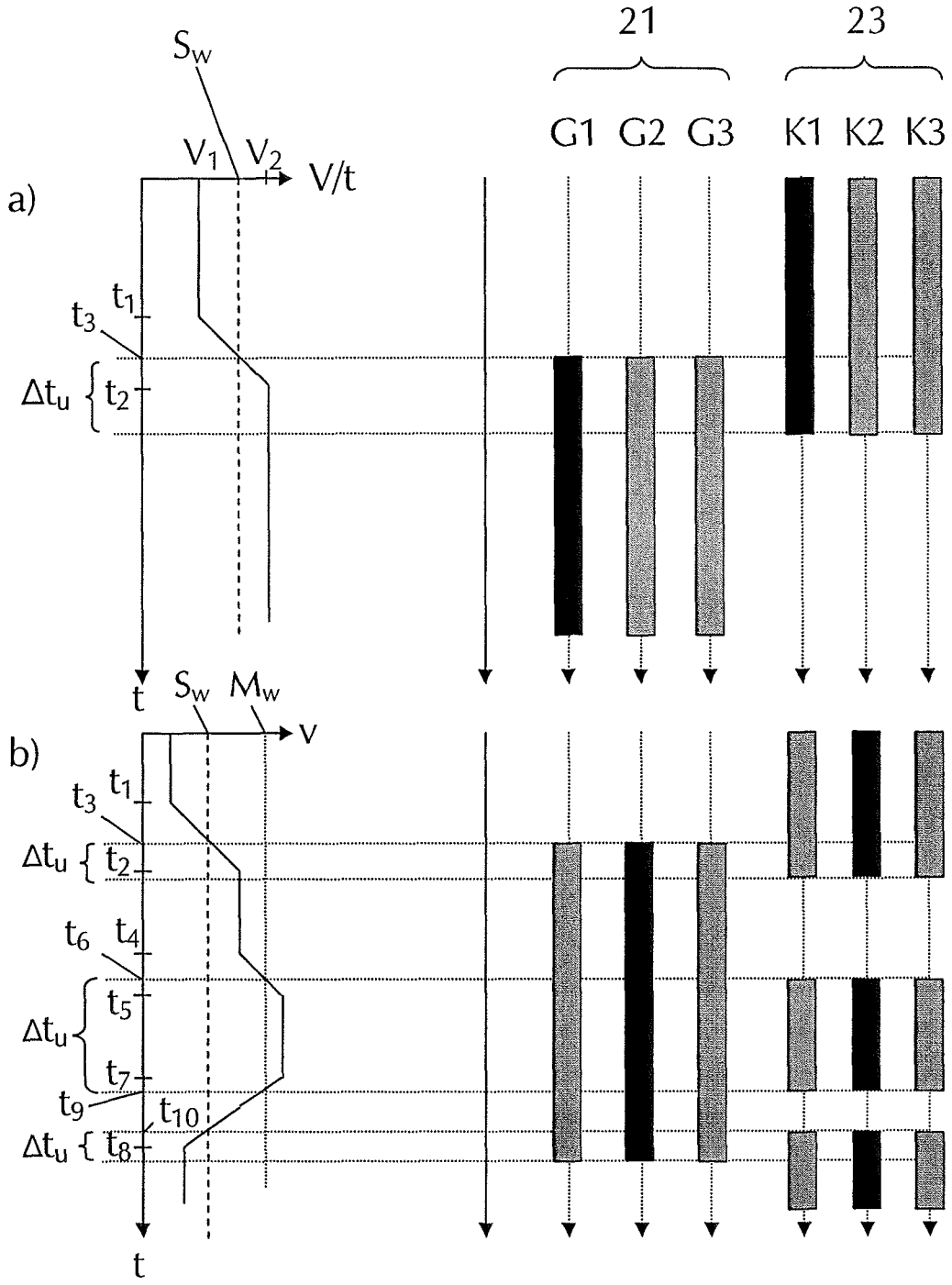
FIG. 6 shows a flowchart of a process for controlling the spraying device of FIG. 5.

FIG. 6 explains the functionality of the control process of the groups G1 to G3 and K1 to K3 of the spraying device 18*c* of FIG. 5. In respect of its fundamental principles this control process can also appropriately be applied to the spraying devices 18*a* and 18*b*. FIG. 6*a*) relates to the increase in the fluid volume introduced into the working chamber 10 by the spraying device 18 per unit of time (V1<V2). The timeline faces downwardly and is labeled with t. To the right of the V/t diagram are the dosing element groups G1 to G3 of the first fluid delivery apparatus 21 and K1 to K3 of the second fluid delivery apparatus 23. If a beam is present, the respective dosing element group G1 to G3 and K1 to K3 is activated and is flowed through by fluid or supplies fluid to the working chamber. If there is no beam under the respective dosing element group at a specific point in time, the respective dosing element group is deactivated or closed or does not supply fluid to the working chamber. The control of the activating states occurs via the control unit 30*c*.

FIG. 6*a* illustrates in the left diagram that at time t1 the flow rate of the fluid volume to be delivered per unit of time into the working chamber is increased from volume $V_1$ to volume $V_2$ by control measures of the control unit 30*c*. The respective volume flow is increased from $V_1$ to $V_2$ from time $t_1$ to time $t_2$. At time $t_3$, which lies between $t_1$ and $t_2$, a previously determined threshold value $S_W$ is exceeded. The control unit 30*c* registers this exceeding and changes from the small outlet nozzles or the dosing element groups K1 to K3 to the large outlet nozzles or the dosing element groups G1 to G3. When exceeding the threshold value $S_W$, the control unit thus switches over between the second fluid delivery apparatus 23 and the first fluid delivery apparatus 21. The relevant aspect in this step is that this changeover does not occur in an ad hoc manner at the time $t_3$, but extends over a time $t_u$ which starts upon exceeding the threshold value $S_W$. Both the originally activated second fluid delivery apparatus 23 which has not yet been deactivated and the first fluid delivery apparatus 21 which was newly activated by the control unit are activated jointly or in an overlapping manner over the time $\Delta t_u$. The second fluid delivery apparatus 23 will only be the activated by the control unit after the expiration of the time window $\Delta t_u$. If the fluid quantity to be dosed is reduced in working operation, the procedure as stated in FIG. 6*a* will occur in reverse sequence. Due to the fact that there is an overlapping range between the two fluid delivery apparatuses 21 and 23, the occurrence of pressure peaks in the line system 20 can be avoided during the changeover of the fluid delivery apparatuses 21 and 23, or it can at least be reduced to a substantial extent.

The spraying device 18*c* of FIG. 5 further allows the individual triggering of two pairs of dosing elements or two pairs of outlet nozzles which are combined by circuitry as groups G1, G2, G3, K1, K2 or K3. This is illustrated in FIG. 6*a* by the tracks of groups G1 and K1 which are colored in black. In addition to the joint activation with the additional two groups colored in grey, it is thus possible for example to provide the singular activation and changeover between the groups K1 and G1.

FIG. 6*b* finally illustrates the control of the spraying device 18*c* by the control unit 30*c* of FIG. 5 by taking into account the travelling speed v of a respectively equipped construction machine. The travelling speed is provided merely as an example for illustrating the principal functionality. Alternatively or additionally, it is also possible to use the milling depth, changing ground properties, the flow rate, etc., for regulation in order to ensure a continuous distribution of the fluid in the ground material to be processed. The left diagram according to FIG. 6*b* therefore shows the speed v or the speed curve of the construction machine.

At the time $t_1$ the machine will accelerate and exceed the threshold value $S_W$. The control unit 30*c* will trigger a changeover from the dosing element group K1 to K3 of the second fluid delivery apparatus 23 to the dosing element groups G1 to G3 of the second fluid delivery apparatus 21, similar to the process of FIG. 6*a*, in order to enable the desired introduction of fluid into the ground material to be processed if at higher working speeds. For reasons of clarity of the illustration, the progression of the volume flow is not shown in closer detail in FIG. 6*b*. In the end, it extends parallel to the development of the travelling speed. The fluid quantity delivered by the spraying device 18*c* to the working chamber will rise with increasing travelling speed and vice versa. It is thus ensured that a constant quantity of fluid is introduced into the ground material to be processed even at different travelling speeds.

Finally, at the time $t_4$ the construction machine will accelerate up to the time $t_5$ and will exceed the maximum value $M_W$ at the time $t_6$. The maximum value is based on the maximum delivery quantity of the fluid into the working chamber with the help of the more powerful fluid delivery apparatus 21. In order to ensure a sufficient supply of the working chamber with fluid in working operation even at maximum travelling speed, the control unit will activate the dosing element groups K1 to K3 of the second fluid delivery apparatus 23 in addition to the first fluid delivery apparatus 21 when exceeding the maximum value $M_W$, so that both fluid delivery apparatuses 21 and 23 are operated in parallel thereafter. If the working speed of the construction machine is then decreased at the time $t_7$ up to the time $t_8$, the travelling speed decreases at first beneath the maximum value $M_W$ at the time $t_9$ and beneath the threshold value $S_W$ at the time $t_{10}$. When falling beneath the maximum value $M_W$, the control unit at first deactivates the fluid delivery of the dosing element groups K1 to K3 of the second fluid delivery apparatus 23. When falling beneath the threshold value, the control unit switches over from the dosing element groups G1 to G3 of the first fluid delivery apparatus 21 to the dosing element groups K1 to K3 of the second fluid delivery apparatus, with the changeover occurring in an overlapping manner over the time interval $\Delta t_u$ in order to prevent pressure peaks in the line system.

It is understood that it is also possible to provide a control of the spraying device 18*c* which is adjusted to the travelling speed in a selective manner with one or two dosing element groups of the first fluid delivery apparatus 21 and/or the second fluid delivery apparatus 23. This is illustrated in FIG. 6*b* by the respective middle dosing element group G2 and K2, which are each colored in black.

No further regulation processes are provided either in FIG. 6*a* or in FIG. 6*b* which are controlled and regulated by the control unit 30*c*. This relates for example to the regulation of the pumping output, the pumping speed, checking the line pressure, etc.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of Applicants' invention.

What is claimed is:

1. A construction machine comprising one of a recycler, a stabilizer or a cold milling machine including a spraying device configured to introduce a fluid into a single working chamber of a working roller of the construction machine, with the working roller being configured to remove ground or road surfaces during processing by the construction machine, wherein the spraying device comprises:

at least one first and at least one second fluid delivery device via which the fluid is introduced into the single working chamber of the working roller of the construction machine, with the at least one first fluid delivery device having at least one dosing element being dimensioned to deliver a larger fluid quantity than at least one dosing element of the at least one second fluid delivery device at a fixed operating pressure so that, per unit of time, the at least one dosing element of the first fluid delivery device supplies a larger fluid volume to the single working chamber than the at least one dosing element of the second fluid delivery device;

a line system via which the fluid is guided to the at least one first and the at least one second fluid delivery device; and a control unit configured to control a volume of fluid delivered to the single working chamber via the at least one first and the at least one second fluid delivery device by controlling activation of the at least one first and the at least one second fluid delivery device individually from each other such that activation by the control unit comprises selectively operating each of: (i) only the at least one first fluid delivery device, (ii) only the at least one second fluid delivery device, and (iii) the at least one first and the at least one second fluid delivery device at the same time.

2. The construction machine according to claim 1, wherein each of the at least one first and the at least one second fluid delivery devices comprises at least two dosing elements.

3. The construction machine according to claim 2, wherein the at least two dosing elements of the at least one first and the at least one second fluid delivery devices are arranged in a manner that, at a fixed operating pressure, the flow rate of the fluid through one of the at least two dosing elements of the first fluid delivery device is in the range of 1.8:1 to 5:1 at a ratio to the flow rate of the fluid through one of the at least two dosing elements of the second fluid delivery device.

4. The construction machine according to claim 3, wherein at the fixed operating pressure, the flow rate of the fluid through one of the at least two dosing elements of the first fluid delivery device is in the range of 2:1 to 3:1 at a ratio to the flow rate of the fluid through one of the at least two dosing elements of the second fluid delivery device.

5. The construction machine according to claim 2, wherein the control unit is arranged in a manner that it individually triggers the at least two dosing elements of the at least one first fluid delivery device and/or the at least one second fluid delivery device.

6. The construction machine according to claim 2, wherein the control unit is arranged in a manner that it triggers the at least two dosing elements of the at least one first fluid delivery device and/or the at least one second fluid delivery device in a grouped manner.

7. The construction machine according to claim 2, wherein the at least two dosing elements comprise outlet nozzles.

8. The construction machine according to claim 1, wherein the control unit is arranged in a manner that it switches over from the at least one first fluid delivery device to the at least one second fluid delivery device depending on exceeding or falling below a threshold value (Sw).

9. The construction machine according to claim 1, wherein upon exceeding or falling below a maximum value (Mw), the control unit will activate at least one of the at least one first and the at least one second fluid delivery devices, or will deactivate at least one of the at least one first and the at least one second fluid delivery devices.

10. The construction machine according to claim 9, wherein the threshold value (Sw) and/or the maximum value (Mw) is a line pressure, a milling depth, a travelling speed and/or a flow rate.

11. The construction machine according to claim 9, wherein the control unit is arranged in the manner that the threshold value (Sw) and/or the maximum value (Mw) vary depending on the fluid.

12. The construction machine according to claim 1, wherein a cleaning device is provided for cleaning the at least one first and at least one second fluid delivery devices.

13. The construction machine according to claim 12, wherein the cleaning device comprises a nozzle cleaning device.

14. The construction machine according to claim 1, wherein the line system comprises a fluid filter.

15. The construction machine according to claim 14, wherein the fluid filter is located before or after a fluid pump.

* * * * *